US006244084B1

(12) United States Patent
Warmack

(10) Patent No.: US 6,244,084 B1
(45) Date of Patent: Jun. 12, 2001

(54) REMOTE CONTROL LOCK DEVICE

(76) Inventor: Tod L. Warmack, Rte. 7 Box 501, Tallahassee, FL (US) 32308

( * ) Notice: Subject to any disclaimer, the term of this patent is extended or adjusted under 35 U.S.C. 154(b) by 0 days.

(21) Appl. No.: 09/182,066

(22) Filed: Oct. 27, 1998

Related U.S. Application Data

(63) Continuation-in-part of application No. 08/032,074, filed on Feb. 27, 1998, now abandoned.

(51) Int. Cl.[7] ..... E05B 49/00
(52) U.S. Cl. ..... 70/278.1; 70/256; 70/280
(58) Field of Search ..... 70/256, 224, 277–283; 292/201, 216, 144

(56) References Cited

U.S. PATENT DOCUMENTS

| | | | | |
|---|---|---|---|---|
| 5,018,375 | * | 5/1991 | Tully | 70/224 |
| 5,083,122 | * | 1/1992 | Clark | 70/278.1 |
| 5,421,178 | * | 6/1995 | Hamel et al. | 70/283 |
| 5,531,086 | * | 7/1996 | Bryant et al. | 70/279 |
| 5,546,777 | * | 8/1996 | Liu et al. | 70/280 X |
| 5,628,216 | * | 5/1997 | Qureshi et al. | 70/280 X |
| 5,685,182 | * | 11/1997 | Chhatwal | 70/224 |
| 5,694,798 | * | 12/1997 | Nunez et al. | 70/283 |
| 5,712,626 | * | 1/1998 | Andreou et al. | 70/278.1 X |
| 5,782,118 | * | 7/1998 | Chamberlain et al. | 70/277 X |
| 5,790,034 | * | 8/1998 | Khoury | 70/256 X |
| 5,791,179 | * | 8/1998 | Brask | 70/283 X |
| 5,862,693 | * | 1/1999 | Myers et al. | 70/282 X |

FOREIGN PATENT DOCUMENTS

| | | | | |
|---|---|---|---|---|
| 4182583 | * | 6/1992 | (JP) | 70/256 |

* cited by examiner

*Primary Examiner*—Suzanne Dino Barrett
(74) *Attorney, Agent, or Firm*—Carnes, Cona and Dixon

(57) ABSTRACT

The present invention is a remote control lock device that is used with any type of rotating lock typically associated with residential homes, offices, or the like. This device can be a singular unit utilized with a dead bolt mechanism, a key operated lock or a combination of a dead bolt mechanism and key operated lock. The locking device comprises a gear assembly having an adapter coupled to the gear assembly and the conventional lock mechanism. A motor assembly is coupled to the gear assembly. Activation of the motor assembly will cause the rotation of the gear assembly. Rotation of the gear assembly will force the adapter to move, causing the conventional lock mechanism to rotate to a desired position.

19 Claims, 9 Drawing Sheets

Fig. 4a
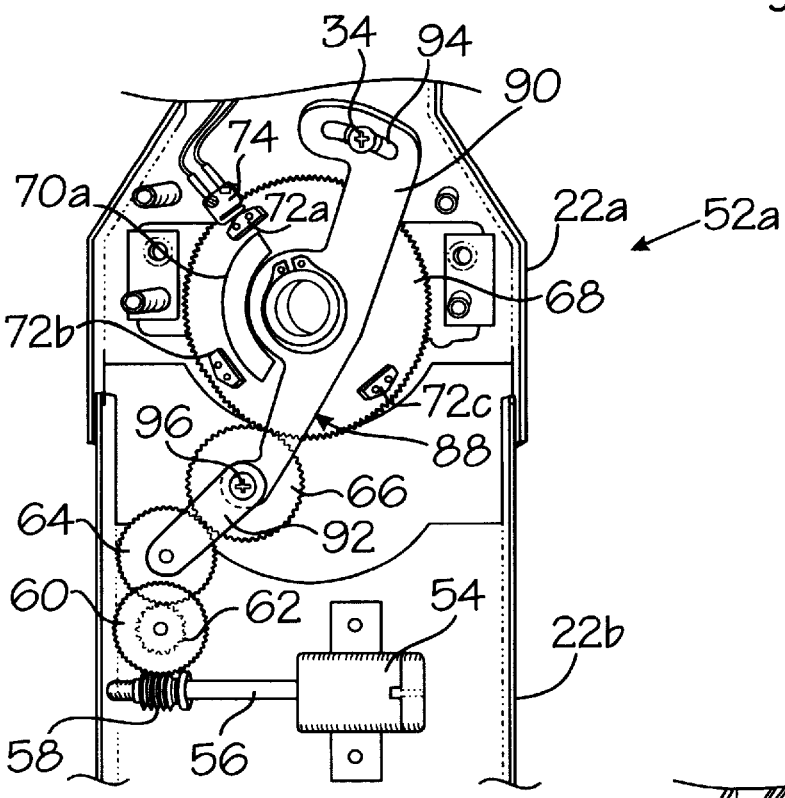
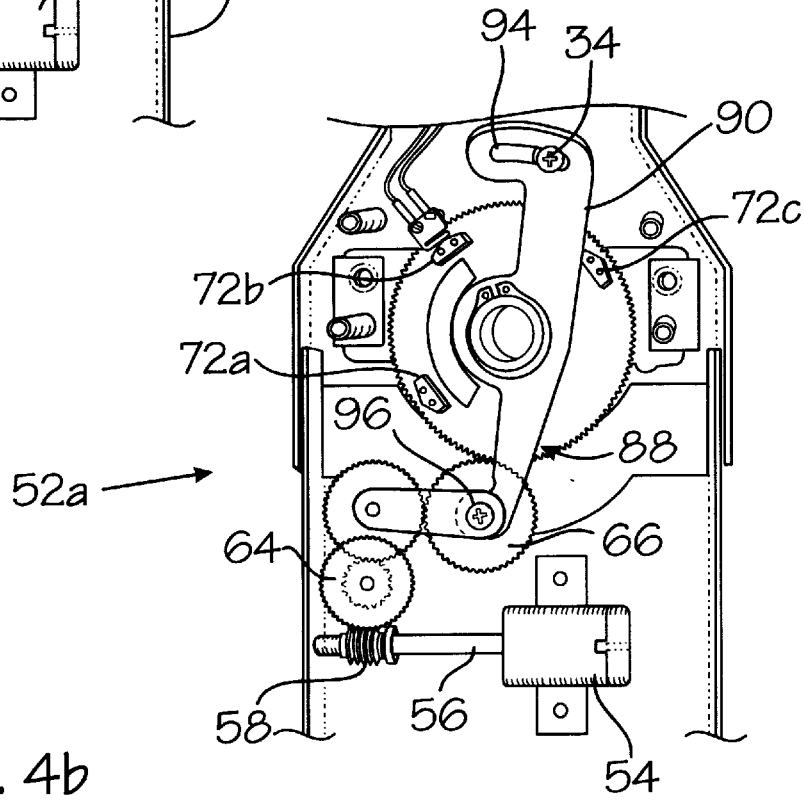
Fig. 4b

REMOTE CONTROL LOCK DEVICE

This is a Continuation-In-Part of application Ser. No. 08/032,074 filed Feb. 27, 1998, now abandoned

BACKGROUND OF THE INVENTION

1. Field of the Invention

The present invention relates generally to a remote control lock device and more particularly to a remote control lock device which can quickly and efficiently lock or unlock either a key lock, dead bolt, or a combination thereof typically associated with lock devices located in homes, offices and other application, by utilizing a hand held remote control transmitter. The unit is designed so as to be compatible with conventional locks on the market and one which will utilize a gear system for adequately engaging and disengaging the locking unit of a conventional door.

2. Description of the Prior Art

Over the years, incidents relating to home burglaries and theft have steadily grown. This increase has concerned the consumer and these concerns have lead them to invest in more elaborate home safety devices, including the use of dead bolts, burglar alarms, a combination thereof, or the like. Though these devices are known to work successfully, they may not offer the needed protection for some consumers. For example, some consumers do not have their keys ready for insertion into the lock and many find themselves searching through their belongings in hopes of finding their keys quickly. This pause in opening the door is a perfect invitation to a thief, robber or the like for jumping, attacking, harming and/or robbing the individual.

In other situations, some may have their hands full of groceries, a child, or the like. This causes their hands to be occupied and unavailable to quickly and efficiently unlock the door. A typical, yet dangerous, scenario.

As such, devices have been developed to assist the consumer and to inherently decrease the time needed to enter a home. One such device is a keyless entry dead bolt lock disclosed in U.S. Pat. No. 5,531,086 issued to Bryant. In this patent, the dead bolt locking system includes an actuator which is coupled to a conventional dead bolt mechanism via a connection rod. The actuator is controlled by way of a motor. This motor is electrically and mechanically connected to a receiver. In operation, a signal from a transmitter is sent to the receiver. This receiver activates the actuator which pulls the connecting rod. This pulling of the connecting rod will inherently cause the dead bolt to rotate. Though this design will allow for the dead bolt to operate via a remote control unit, this system does suffer some shortcomings. One such shortcoming is that this configuration requires the device to extend horizontally across the door. This horizontal displacement can be obtrusive and bulky, thereby producing a product which is not aesthetically pleasing—something undesirable by many consumers. In addition, the design and configuration of the connecting rod to the conventional dead bolt and actuator is such that after extended use, it may dislodge therefrom. This dislodgment will defeat its intended purpose. Further still, this system is solely utilized for dead bolts and does not address other locking systems typically used in a home, office or the like.

Accordingly, it is seen that there exists a need for a system which can be installed and/or retrofitted easily and quickly to any existing door lock system, typically associated with homes, offices, or the like. Such a device should produce successful results without being obtrusive and bulky when installed.

As shown, none of these previous efforts provide the benefits intended with the present invention as identified by the needs above. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a remote control lock device that is designed and configured to be used on any type of rotating lock typically associated with residential homes, offices, or the like. This device can be a singular unit utilized with a dead bolt mechanism, a key operated lock or a combination thereof. Optionally, this system can be a kit which can be retrofitted and coupled to an existing dead bolt lock, a key operated lock, or a combination thereof. The unit is specifically designed with an adjusting mechanism so as to enable the product to be acceptable to all commercially available locks.

This particular unit is structured so as to be compact in size and dimension and to provide for a final product which is efficient, successful, and aesthetically pleasing.

The present invention is versatile and in one embodiment, the unit will be coupled solely to a deadbolt. In an alternative embodiment, the unit will solely be coupled to the a door knob having a conventional key lock secured thereto. When coupled to the door knob lock mechanism, the present invention will control the locking mechanism and not the door knob itself, so as to provide for the lock to rotate. In yet an alternative embodiment, the unit of the present invention will be coupled to both the deadbolt and the conventional key lock. Coupling the unit to both the deadbolt and the conventional key lock is the preferred embodiment.

When the present invention is coupled to the deadbolt, the rotating shaft member of the deadbolt will be mechanically coupled to the rotating means. The rotating means comprises a motor wherein its shaft is threaded in order to provide for the shaft to act as an auger. Coupled to the shaft is a first gear. The first gear is coupled to a second gear or connecting gear. This second gear or connecting gear, can optionally be coupled to a linkage gear. The connecting gear, or if used, the linkage gear, is coupled to a control gear. This control gear is centrally located around the conventional shaft of the deadbolt unit, but is not coupled to the conventional shaft of the deadbolt unit.

Secured to the locking mechanism of the conventional deadbolt is a finger adapter. This finger adapter is attached to the shaft of the deadbolt and includes a U-shape member extending outwardly and downwardly therefrom. Located in the control gear is a channel. The U-shape member is received within this channel.

Hence, during activation of the motor, located in proximity to the deadbolt, the auger (shaft of the motor) rotates. The rotation will cause the first gear to rotate, which will inherently cause the second gear to rotate and cause the rotation to reach the third or the control gear. Rotation of the control gear will provide for the member located within the channel to revolve, consequently causing the finger, and ultimately the lock mechanism to turn.

The control gear controls the amount of rotation by having a plurality of cams located thereon. A central cam provides for the device to be in a neutral position. A lock cam is located on one side of the central cam while an unlock cam is located on the opposite side of the central cam. A micro-switch is located in proximity to the control gear and is in engageable contact with each cam. Accordingly, in operation, rotation of the gear will cease upon the contact between the particular cam and the micro-switch. For example, if the deadbolt is in an unlock position and the user wants to lock the unit, the motor will run and continue to run until the micro-switch engages the lock cam. Once contact is made, the control gear returns to its neutral position to enable further operation of the unit.

When the device is used with a door knob lock, a specially designed control shaft is coupled to the locking mechanism of the conventional door knob. This control shaft will allow for the rotation of the lock, but not the rotation of the knob. Thereby, centralizing the control of the locking mechanism.

In this configuration, a motor assembly is located in proximity to the door knob. The shaft of the motor is threaded to provide for the shaft to have an auger configuration. This auger is coupled to a first gear. This first gear is coupled to a second gear. This second gear is coupled to a third gear. Depending on the conventional lock, the second gear or third gear is coupled to a control gear. This control gear is centrally located over the lock mechanism of the door knob.

Secured to the lock mechanism of the conventional door lock is a finger adapter. This finger adapter is attached to the lock mechanism of the doorlock and includes a member extending outwardly and downwardly therefrom. Located in the control gear is a channel. The member is received within this channel.

Hence, during activation of the motor, located in proximity to the doorknob, the auger rotates. The rotation will cause the first gear to rotate, which will inherently cause the subsequent gears to revolve. Activating the control gear forces the member located within the channel to revolve, consequently the lock mechanism to turn.

If the unit is not coupled to a deadbolt a control system, as described above, is utilized having a plurality of cams, secured on, and a micro-switch located in proximity to the control gear. This will enable adequate rotation for efficiently and functionally lock and unlock the conventional lock mechanism of the conventional doorknob.

It is noted that in the embodiments described above, the connecting gears are used solely to couple and connect the rotating mechanism of the motor to the control gear. The number of gears used for connection can be decrease and/or increased, depending on the distance between the motor and the control gear.

When utilizing the present invention on both a deadbolt and the key lock, the gear assembly, as defined above is utilized. Only one motor and one control system is used for both units. In this arrangement, upon activation of the motor, the appropriate and respective gears will rotate, for inherently providing the locking mechanisms to travel in the desired position (lock or unlock).

Accordingly, it is the object of the present invention to provide for a remote control lock device which will overcome the deficiencies, shortcomings, and drawbacks of prior lock devices, remote control lock devices and methods thereof.

Still another object of the present invention is to provide for a remote control lock device which is easy to use, successful in operation, non-obtrusive and aesthetically pleasing.

Another object of the present invention is to provide for a remote control lock device that locks and unlocks any style or type of rotating lock and which will also operate independently from the remote control device.

A further object of the present invention is to provide a remote control lock device that can be retrofitted and installed to existing and conventional locks, typically associated with residential homes, offices, or the like, and without marking or marring the existing door.

Still a further object of the present invention, to be specifically enumerated herein, is to provide a remote control lock device in accordance with the preceding objects and which will conform to conventional forms of manufacture, be of simple construction and easy to use so as to provide a device that would be economically feasible, long lasting and relatively trouble free in operation.

Although there have been some inventions related to a remote control lock device, none of the inventions utilize a rotating means nor do the inventions address key locks, typically associated with knobs of the door. The present invention is simple in design, compact in size, economically feasible, and easy to install and maintain. Installation for retrofitting the unit to an existing lock requires a minimal amount of training to successfully complete.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

FIG. 4*a*–FIG. 4*c* top view of the gear assembly used with the remote control lock device of the present invention for controlling the rotation of the conventional deadbolt assembly and illustrating the length adjusting means for the remote control lock device of the present invention.

Similar reference numerals refer to similar parts throughout the several views of the drawings.

DESCRIPTION OF THE PREFERRED EMBODIMENTS

The present invention is a remote control lock device designed and configured to manipulate and control the lock mechanism in a conventional deadbolt, conventional door knob lock assembly, or a combination thereof. In the preferred embodiment, the present invention is used with both a deadbolt and a door knob lock assembly as is typical in conventional residential homes. The apparatus is structured so as to be compact, non-obtrusive, and which will not mark nor mar the existing door.

Figure 1A:
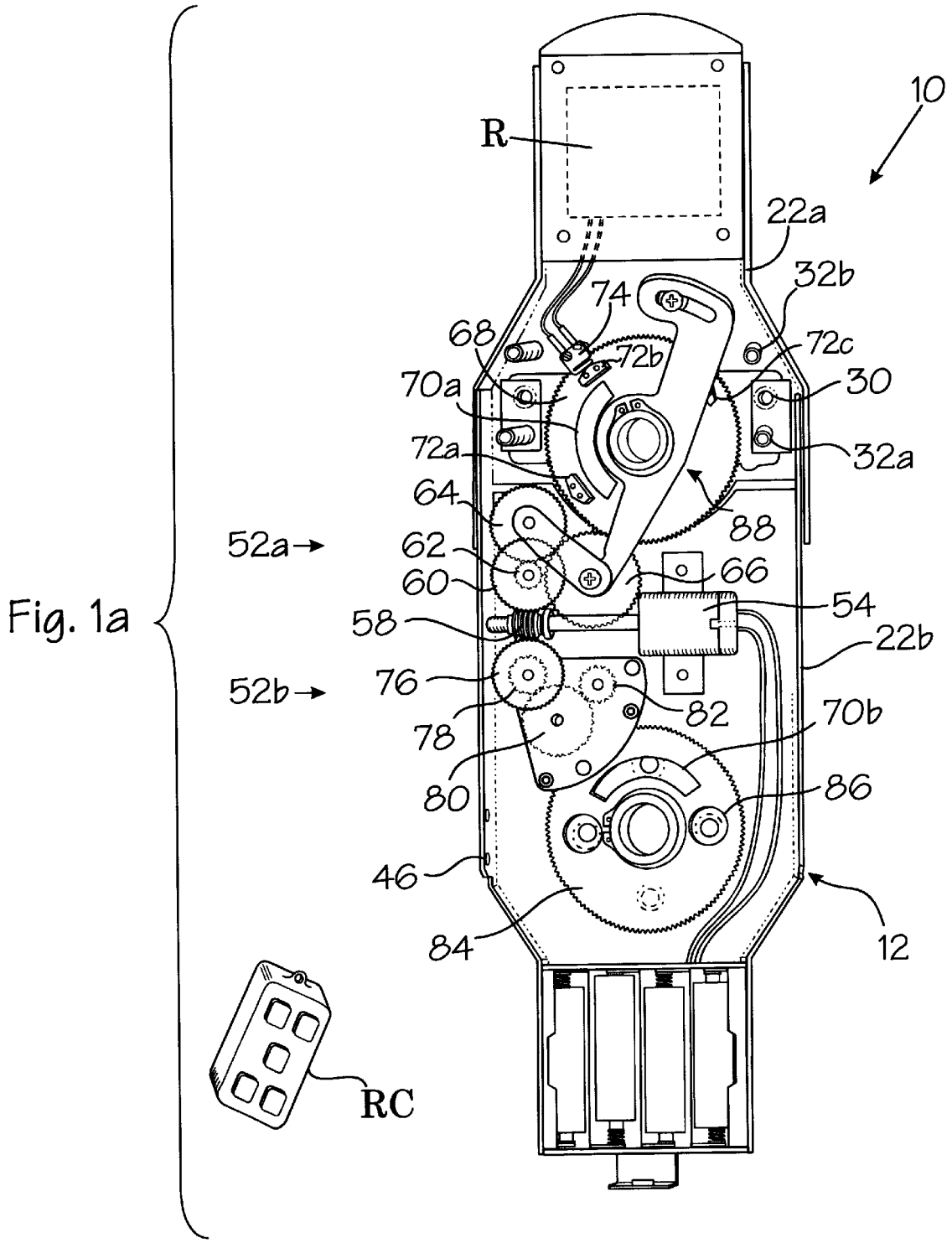
FIG. 1*a* is a top view of the assembled the remote control lock device of the present invention for use with a conventional deadbolt assembly and a conventional door knob lock assembly, having the cover removed therefrom.
Figure 2:
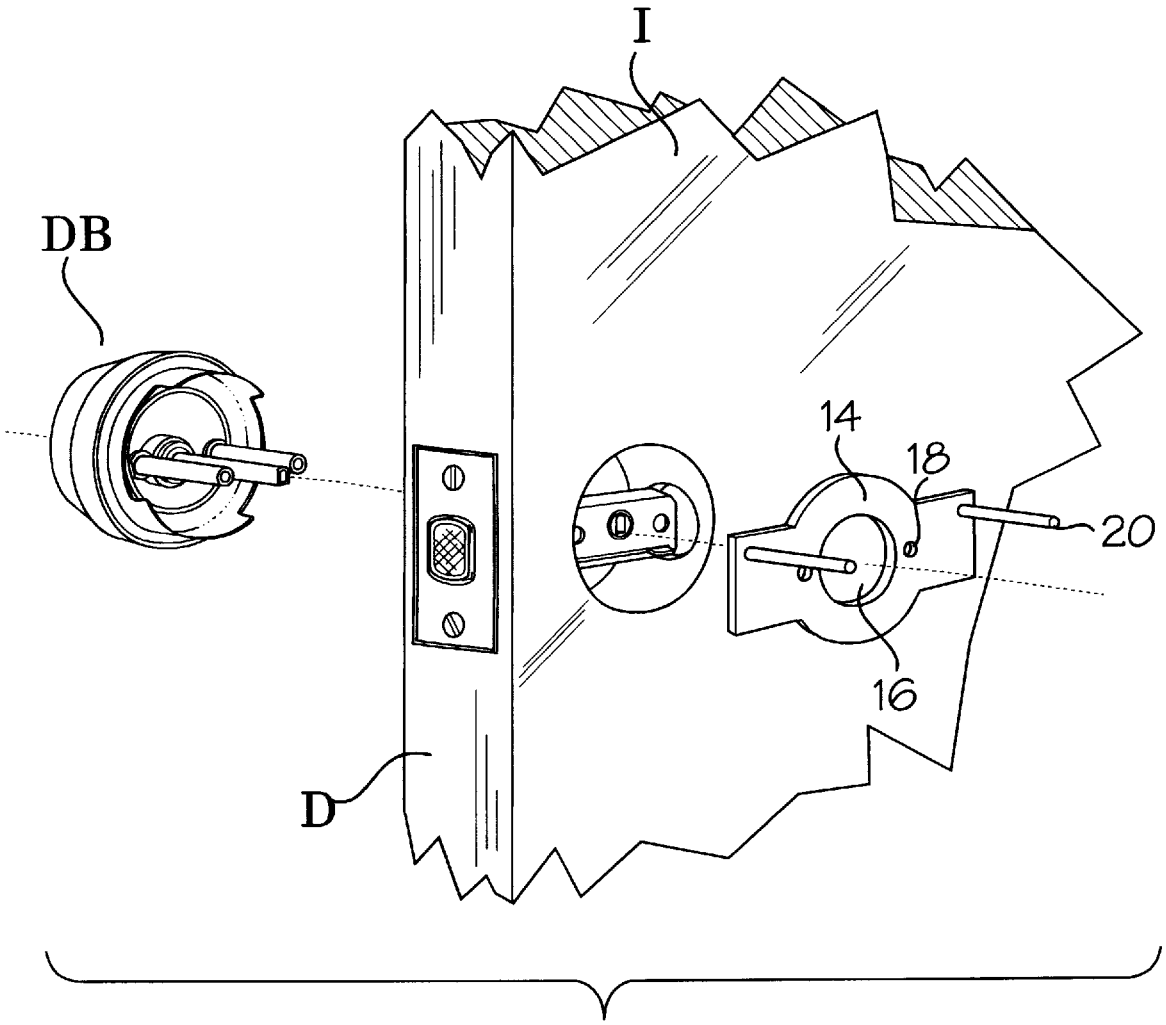
FIG. 2 is an exploded perspective view of the mounting bracket used for securing the remote control lock device of the present invention to a conventional deadbolt without marring or marking the conventional door.
Figure 9:
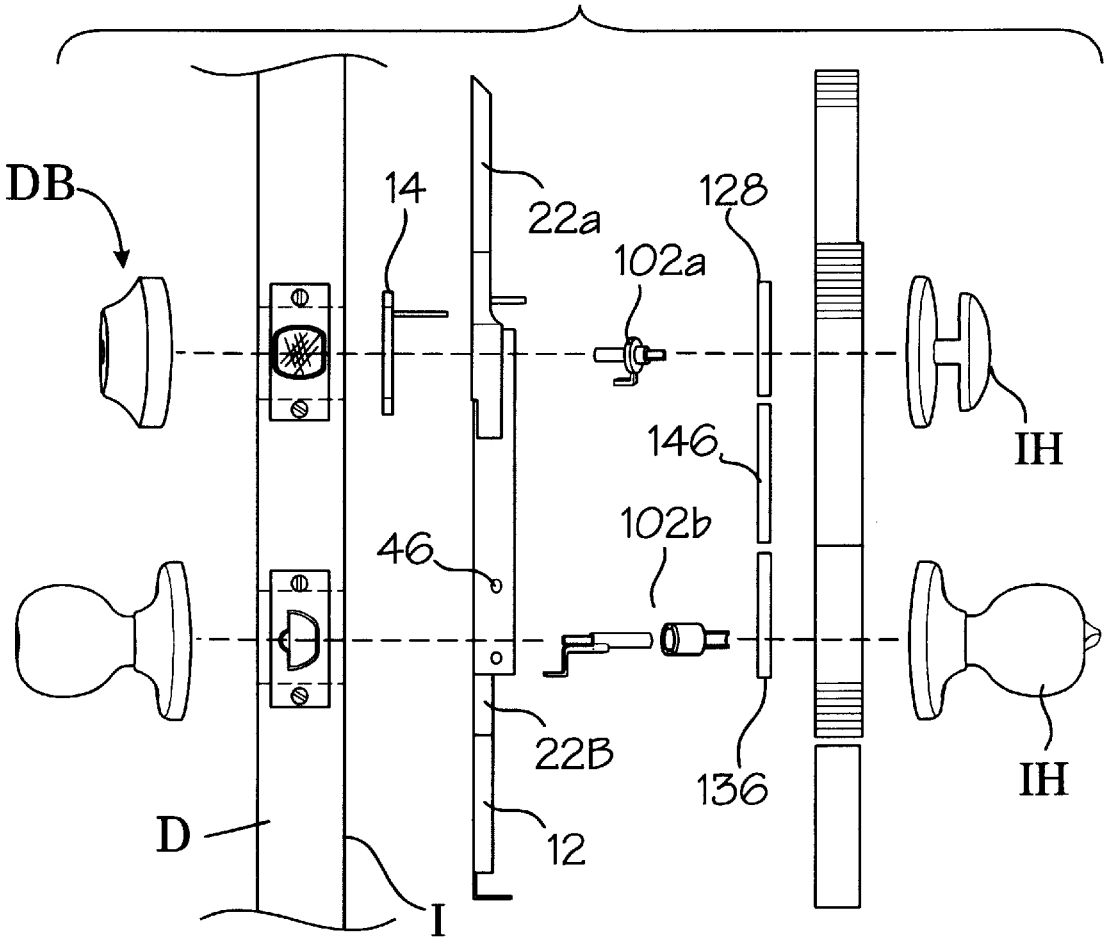
FIG. 9 is an exploded side view of the remote control lock device of the present invention, prior to attaching to a conventional door.

With reference to the drawings, in particular to FIGS. 1*a*, 2 and 9 thereof, the first embodiment of the present invention will be described, wherein the apparatus is used on both a conventional deadbolt assembly and a conventional door knob lock assembly. As seen in these figures, the present invention is a remote control lock device 10 having a modular unit 12. Located on the module unit 12 is a conventional receiver (R) that can receive signals from a conventional remote control unit (RC). In essence, the conventional receiver (R) receives a transmitted signal via the remote control unit RC (transmitter). Upon receiving the signal, the present invention 10 is activated and enables the locks to rotate accordingly, either in a lock position or an unlock position.

The module unit 12 is designed to be coupled to the interior surface of the existing door. This will provide for the module unit 12 to be sandwich between the interior surface I of the conventional door D and the interior hardware IH used with the conventional lock assemblies. This arrangement is illustrated in FIG. 9. Such an arrangement will also enable the conventional lock mechanism to extend partially through the present invention 10.

In order to attach the module unit 12 to the existing rotating dead bolt unit DB located within an existing door (partially illustrated in FIGS. 2 and 9), a mounting bracket 14 is used. This mounting bracket is illustrated in further detail in FIG. 2 and FIG. 9. As seen in these figures, the mounting bracket 14 includes an aperture 16 for rendering exposure of the conventional deadbolt lock assembly DB. Located on opposite sides of the aperture is a pair of threaded through holes 18. These threaded holes 18 are configured so as to align with the existing holes (illustrated, but not labeled) of a conventional deadbolt lock assembly. Screws or the like are inserted into the threaded holes 18 and then into the holes located in the conventional deadbolt lock assembly DL in order to secure the mounting bracket 14 to the conventional door. Extending outwardly from the front of the bracket 14 is a pair of externally threaded rods 20. These externally threaded rods 20 will receive the module unit 12 and thus prevent any damage to occur on the existing door D.

In the preferred embodiment, the module unit 12 comprises a first support brace 22*a* secured to the mounting bracket 14 and a second support brace 22*b* secured to the conventional doorknob lock mechanism. The preferred embodiment for the module unit 12, including the first support brace 22*a* and second support brace 22*b* are illustrated in further detail in FIGS. 1*a*, 3*a*, 3*b*, and 9.

As seen in these drawings, the first support brace 22*a* will be located in proximity to the deadbolt assembly and includes a receiving area 24 (see FIG. 3*a*) for receiving either the conventional receiver or for receiving the power source, such as batteries. The receiver (R) is illustrated as being secured to the receiving area 24 in FIG. 1*a*.

Figure 3A:
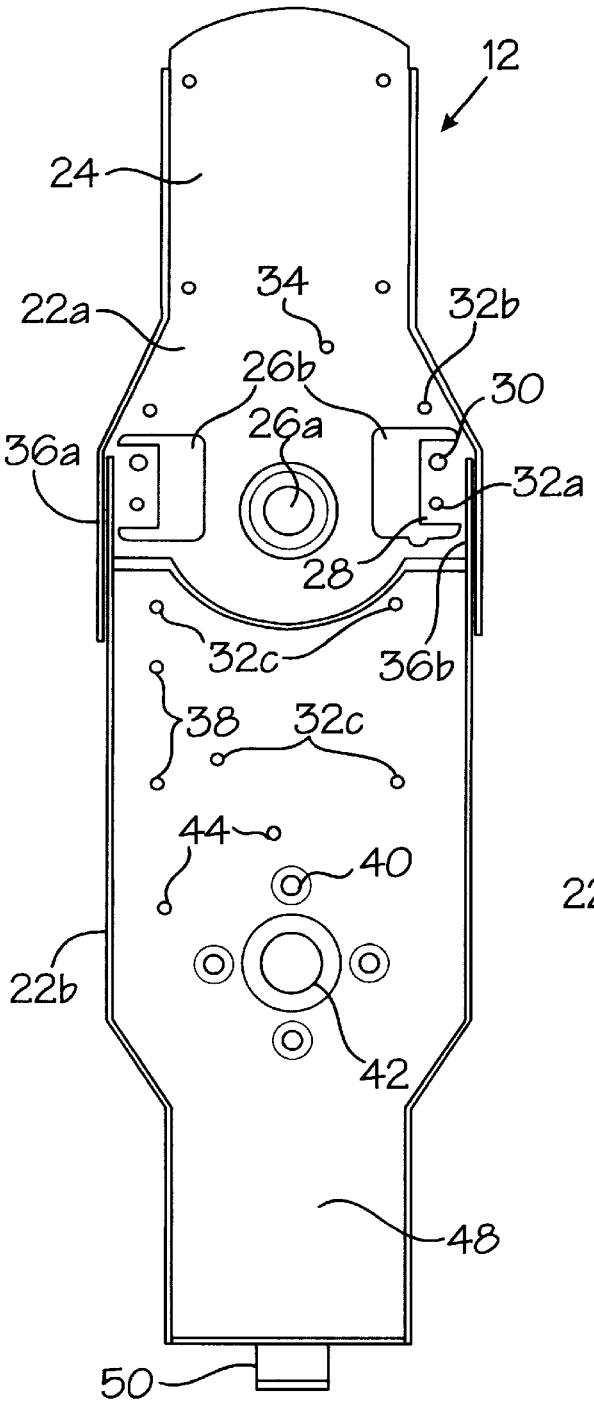
FIG. 3*a* is a top front planar view of the supporting plates used for the supporting the components for the remote control lock device of the present invention when it is used with both the conventional deadbolt assembly and a conventional door knob lock assembly.
Figure 3B:
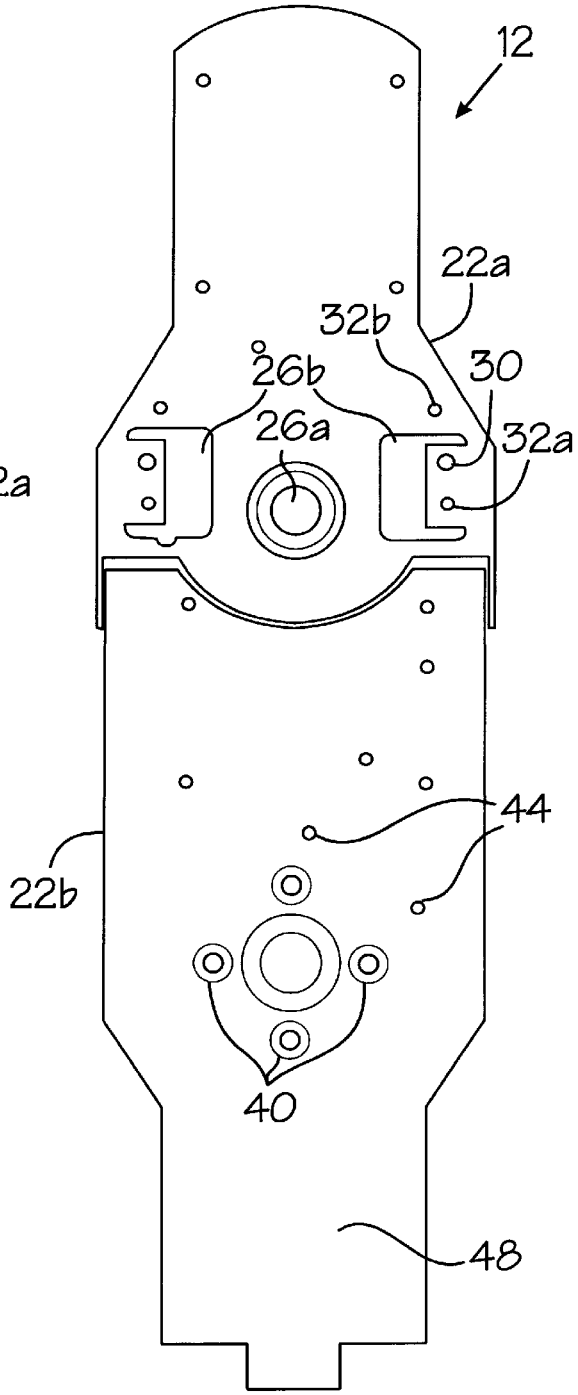
FIG. 3*b* is a rear planar view of the supporting plates used for the supporting the components for the remote control lock device of the present invention when it is used with both the conventional deadbolt assembly and a conventional door knob lock assembly.

Located within the first support brace 22*a* is a central opening 26*a*. This opening allows for the conventional locking mechanism to be visual and extend therethrough. As seen in FIGS. 1*a*, 3*a* and 3*b*, located on opposite sides of the central opening 26*a* is a pair of outer openings 26*b*. A flange 28 extends partially into each outer opening 26*b*. Located in each flange 28 is an orifice 30 for receiving the threaded rod 20 of the mounting bracket 14. This will enable the module 12 to be secured onto the interior area of the door. Nuts or the like will be tightened onto the threaded shaft of the mounting bracket for firmly securing the first support brace to the door. Thereby, providing for the exteriorly threaded rod 20 of the mounting bracket 14 in combination with the orifices 30 of the first support brace 22*a* to act as an attaching means. It is noted that the size and amount of the threaded rod(s) and orifice(s) can be changed and altered by one of ordinary skill in the art so as to provide for an alternative arrangement which will act as an attaching means.

Also located on each flange 28 is a hollow interiorly threaded shaft 32*a*. Located above the opening 26 is a pair of spaced apart hollow threaded shafts 32*b*. These hollow threaded shafts, 32*a* and 32*b* are used for receiving a receiving plate, which will receive and maintain the conventional exterior components of the conventional deadbolt assembly. This arrangement of the plates and conventional exterior components of the deadbolt assembly are shown in FIG. 9.

Affixed above the second set of hollow internally threaded shafts 32*b*, as seen in FIG. 3*a* is a receiving hollow rod 34.

This hollow rod is part of the length adjusting assembly for adjusting the length of the overall module unit 12. This will allow for the device to be used on any door, regardless of the distance between the existing deadbolt and door knob. The length adjusting means is discussed in further detail in FIGS. 4*a*–4*c*.

Illustrated in FIGS. 1*a*, 3*a* and 3*b*, the first support brace 22*a* receives the second support brace 22*b* by enabling projections 36*a* to slidably receive projections 36*b* of the second support brace. This will allow for the module unit 12 to be adjustable in length via the use of the length adjusting means as will be discussed in further detail in FIGS. 4*a*–4*c*.

A plurality of hollow internally threaded shafts 32*c* extend upwardly from an upper region of the second support brace 22*b*, as is seen in FIG. 3*a*. This third set of internally threaded shafts 32*c* will receive the support bracket of the rotation means, in this embodiment, a motor assembly. This motor assembly and the support bracket for the motor assembly is discussed in further detail in FIGS. 4*a*–4*c* and FIG. 7*c*, respectively. Extending upwardly and between the threaded shafts 32*c* are a pair of axles 38. These axles are permanently affixed to the second support brace 38 an d receive gears of the rotating assembly.

Attachment apertures 40 are located within the central area of the second support brace. These attachment apertures 40 will be used for attaching the second support brace 22*b* to the conventional lock mechanism of a door knob. The use of a plurality of holes will enable the user to attach the second support brace to any type or style of lock commercially available. This will permit for the attachment apertures 40 to be aligned with the existing holes located within a conventional doorknob lock assembly. Once aligned, screws, or the like, are inserted into the attachment apertures and extend into the existing holes. This will provide for the second brace 22*b* to be affixed to the conventional door without marking or marring the door assembly. Accordingly, the attachment apertures 40 along with the screws, or the like, provide for an adjustable attaching means, or a second attaching means.

As seen in FIGS. 3*a* and 3*b*, the holes are located symmetrically with respect to the central hole 42. This is done so as to permit for any type of lock to be secured to the conventional door assembly. Generally, the holes are located either vertically and linearly or horizontally and linearly. As seen in the figures, the use of holes and its arrangement will allow for either type of configuration (vertical and linear or horizontal and linear).

Shown, centrally located between the attaching apertures 40 is the central opening 42. This opening is designed and configured to receive the conventional components of the conventional door knob assembly.

Extending upwardly from the second support brace 22*b* is a pair of adjusting rods 44 which are hollow and internally threaded. The adjusting rods 44 are used, in combination with an adjusting plate, for adjusting the rotating mechanism, used to rotate the conventional lock mechanism for a particular brand of lock that are commercially available.

The first and second support braces 22*a* and 22*b*, respectively, each include extending side walls, as seen in FIGS. 1*a* and 9. Extending through the side wall of the second support brace 22*b* are a plurality of through holes 46. These through holes are used for aligning with holes located within a receiving plate. The aligned holes will receive a screw or the like to secure the receiving plate to the second support brace 22*b*. The receiving plate will receive and maintain the conventional exterior components of the conventional door knob assembly, which will be discussed in further detail in FIG. 7*b*.

As seen in the FIG. 3*a*, the second support brace 22*b* further includes a receiving area 48 for receiving either the conventional receiver or for receiving the power source, such as batteries. The power source, illustrated, but not labeled in FIG. 1*a*, is secured to the receiving area 48. This power source is shown as a series of batteries.

Optionally, a U-shape bracket can extend outwardly and upwardly from the lower portion of the second support member, for enabling an attaching means 50 to extend therethrough. This attaching means 50 will allow for a housing to be secured and affixed over the power source. This housing is illustrated and discussed in further detail in FIG. 8.

It is noted that the first support brace and the second support brace can be combined to form one integral unit, thereby eliminating the need for an adjusting means. With an integral unit, the adjusting hollow rod 34 is eliminated, as well as the protrusions 36*a* and 36*b*. This will provide for a single and integral support brace.

The back surface of the module unit can include spacers, shown in FIG. 3*b*, but not labeled. These spacers would surround the central openings 26*a* and 42, respectively, and will prevent the module unit from contacting the door. This will further protect the door from damage and possible marring.

Figure 4C:
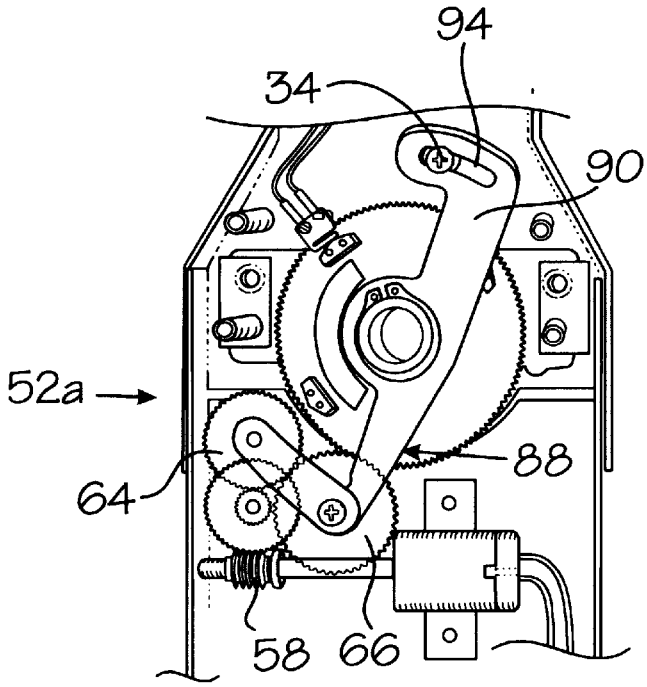
Figure 5A:
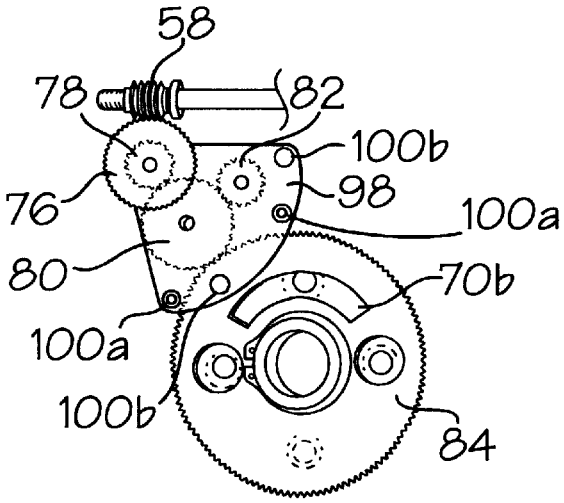
FIGS. 5*a* and 5*b* are top planar views of the gear assembly used for rotating the lock mechanism for a conventional door knob assembly and also illustrated is a lock adjusting means for altering the gear assembly for the enabling utilization of the remote control lock device of the present invention on any commercially available conventional door knob lock assembly.
Figure 5B:
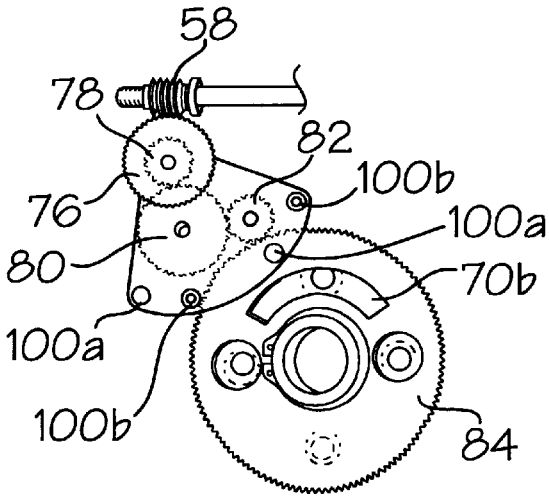

A gear assembly is used to rotate the conventional locking mechanism of the deadbolt and the door knob lock assembly. The gear mechanism used with the present invention is illustrated in FIG. 1*a*, FIG. 4*a*, FIG. 4*b*, FIG. 4*c*, FIG. 5*a*, and FIG. 5*b*. FIGS. 4*a*–4*c* show the gear assembly for the deadbolt locking mechanism while FIGS. 5*a* and 5*b* illustrate the gear assembly of the doorknob locking mechanism. As seen in these figures, a deadbolt gear assembly 52*a* (FIGS. 1*a*, 4*a*, 4*b*, and 4*c*) and a doorknob gear assembly 52*b* (FIGS. 1*a*, 5*a* and 5*b*) is provided for rotating the lock mechanism of the conventional door lock assembly.

The deadbolt gear assembly includes a motor 54 having a shaft 56. The shaft 56 includes an outer end which is shape as an auger 58. This auger 58 contacts and engages a first rotating gear 60. This rotating gear 60 is coupled to a gear shaft 62 to provide for the rotating gear to be located above the gear shaft 62. Contacting and engaging the gear shaft 62 is a fixed gear 64. An adjusting gear 66 is coupled to the fixed gear 64 for enabling adjustment within the module unit 12. This will allow for the length of the module unit to be adjusted accordingly. Engaging the adjusting gear 66 is a control gear 68.

This control gear 68 is centrally located around the conventional shaft of the deadbolt unit, via the central opening illustrated, but not labeled, but is not coupled to the conventional shaft of the deadbolt unit. The control gear further includes a channel 70*a*. This channel 70*a* receives an adapter which is coupled to the rotating lock mechanism of the conventional deadbolt. Upon rotation of the control gear, the channel moves the adapter, which will consequently force the lock mechanism to turn to a desired direction. This adapted is illustrated and discussed in further detail in FIG. 7*a*.

The control gear 68 controls the direction of rotation by having a plurality of cams 72*a*, 72*b*, and 72*c*, located thereon. A central cam 72*b* provides for the device to be in a neutral position. A lock cam is located on one side (72*a* or 72*c*, dependent on the type and style of deadbolt being utilized) of the central cam 72*b* while a unlock cam (72*a* or 72*c*, dependent on the type and style of deadbolt being utilized) is located on the opposite side of the central cam. A micro-switch 74 is located in proximity to the control gear and is in engageable contact with each cam. Accordingly, in operation, rotation of the gear will cease upon the contact between the particular cam and the micro-switch. For example, if the deadbolt is in an unlock position and the user wants to lock the unit, the motor will run and continue to run until the micro-switch engages the lock cam. Once contact is made, the control gear returns to its neutral position to enable further operation of the unit.

It is noted that the gear shaft 62 was provide as a space saving means, but can be eliminated if desired. In addition, the auger can be directly coupled to the fixed gear. Optionally, it is further noted, that the size of the gears and number of gears utilized is dependent on the location of the motor with respect to the deadbolt assembly, and can be altered, reduced and changed as deemed necessary by an ordinary artesian in the field of gear assembly.

The door knob gear assembly 52*b* includes a first gear 76 which is coupled to the auger 58. A gear shaft 78 is secured to the first gear 76. A linking/activating gear 80 is engaged to the gear shaft 78 and in an alternative arrangement is directly coupled to the control gear 84. This linking/activating gear 80 will directly engage the control gear 84 when a particular type of lock is used, such as the ones produce by SCHLAGE. If not contacting the control gear, then an activating gear 82 is sandwich between the linkage gear and the control gear, as illustrated in FIG. 5*b*. This arrangement is ideal for use with lock made by TITAN and KWIKSET. In summary, either gear 80 or 82 will be used to rotate the control gear 84. An adjusting plate is used to move and adjust the gears accordingly. This adjusting plate is illustrated and discussed in further detail in FIGS. 5*a*–5*b*.

It is noted that the gear shaft 78 was provide as a space saving means, but can be eliminated if desired. In addition, the auger can be directly coupled to the linking/activating gear 80. Optionally, it is further noted, that the size of the gears and number of gears utilized is dependent on the location of the motor with respect to the door knob assembly and that alterations and changes may be made by one having ordinary skill in the art without departing from the scope of the present invention.

The control gear 84 is centrally located around the conventional shaft of the doorknob unit via the central opening illustrated, but not labeled, and is not coupled to the conventional shaft of the doorknob unit. The control gear further includes a channel 70*b*. This channel 70*b* receives an adapter which is coupled to the rotating lock mechanism of the conventional deadbolt. Upon rotation of the control gear, the channel forces the adapter to rotate. Upon rotation of the adapter, the lock mechanism will inherently turn to the desired direction. This adapter is illustrated and discussed in further detail in FIG. 6*b*.

Apertures 86 are also located within the control gear 84 for exposing the plurality of openings 40 located within the second support plate 22*b*. This will enable the second support brace to be secured to the conventional door knob lock assembly and yet provide for the screws inserted therein to be located under the gear, so as to be non-obtrusive. During activation, the motor will cause the shaft 56 to rotate. The rotation of the shaft will cause the auger 58 to turn which provide for the first gear to rotate. The rotation of the first gear 76 causes the gear shaft 78 to revolve, intrinsically causing the linkage/activation gear 82 to rotate. Dependent on the lock be used, either the activation gear 84 or the linkage/activation gear 82 will allow for the rotation of the control gear. Rotation of the control gear will cease upon the contact between the particular cam, secured to the control gear of the deadbolt unit, and the micro-switch. In this arrangement, the locking mechanism of both the deadbolt and doorknob can be rotated and controlled simultaneously.

Adjusting the length of the module unit 12 is accomplished by the use of a linkage system 88 illustrated in FIGS. 1*a*, 4*a*, 4*b* and 4*c*. As seen in these figures, the linkage system comprises a first pair of connecting bars 90 pivotally secured to a second pair of connecting bars 92.

The first pair of connecting bars 90 receives the control gear 68, but not secured thereto. This will provide for the control gear 68 to be located between the first pair of the connecting bars 90, but not coupled thereto. Located at a first end of the first pair of connecting bars is a channel 94. Pivotally secure at the second end or opposite end of the first pair of connecting bars is the first end of the second set of connecting bars 92. The adjusting gear 66 is centrally coupled to the second end of first pair of connecting bars 90 and the first end of the second pair of connecting bars 92 via pivot point 96. The second end of the second pair of connection bars 92 is pivotally secured to axle 38 of the second support brace 22*b*. This axle is permanently secured to the second support brace to provide for the first gear 64 to be a fixed position and to render a fixed gear.

The adjusting hollow rod 34 (see FIGS. 1*a*, 4*a*, 4*b* and 4*c*) is affixed to the first support plate 22*a* and thus receives the channel 94. This arrangement will provide for the channel to slide freely and linearly with respect to the adjusting hollow rod, intrinsically causing the first pair of connecting bar members to control and move the second pair of arm members 92 in an upward or downward position. This will inherently cause the adjusting gear 66 to rotate freely about the first gear 64 and control gear 68 for innately increasing or decreasing the total length of the module unit 12. For locking the device in the desired position, a screw or the like, is inserted into the adjusting hollow rod.

To adjust the length, the user removes the screw from the adjusting hollow rod 34. Placing one hand on the first support brace and the second hand on the second support brace, the user moves the first support brace either upward or downward. This upward lifting will increase the length, causing the first pair of connection bars 90 to lift up the second pair of connecting bars 92 (see FIG. 4*a*). In this arrangement, the gears will be aligned linearly.

Pushing the first support brace downward will force the first pair of connection bars 90 to push down the second pair of connection bars (see FIGS. 5*b* and 5*c*). This will cause the rotating gear 66 to rotate down and about the fixed gear 64. Once the desired position is obtained, the screw is reinserted into the hollow threaded rod 34. Hence, the linkage system constitutes a length adjusting means for adjusting the length of the module unit 12.

For enabling adaptation of the present invention to work with a particular brand of door knob locks, an adjusting means is provided. This adjusting means utilizes the adjusting plate 98, illustrated in FIGS. 1*a*, 5*a* and 5*b*. As seen in these drawings, the adjusting plate is plate which includes two gears (80 and 82) affixed thereto. The adjusting plate 98 enables the user to select the particular gear which is to contact, engage and rotate the control gear 84. As such the adjusting plate 98 is pivotally secured to axle 38 (see FIG. 3*a*) of the second support brace 22*b*. This axle 38 also receives the shaft gear 78 to provide for the plate to be located above and not in communication with the shaft gear 78. Located on opposite ends of the adjusting plate 98 are two sets of spaced apart adjusting holes 100*a* and 10*b*, respectively. Each set of hole is adapted to align with adjusting rod 44 located on the second support brace 22*b*. This will enable a screw or the like to be removable secured within the particular hole and within the adjusting rods 44 to provide for the adjusting plate to be in a fixed and secured position.

Using holes 100*a* to lock the adjusting plate 98 provides for gear 80 to contact and engage the control gear 84 (see FIG. 5*a*). This will provide for the plate to shift gear 82 upward, so as to prohibit contact with the control gear. Using holes 100*b* to lock the adjusting plate 98 provides for gear 82 to be shift downward for contacting and engaging the control gear 84 (see FIG. 5*b*). This will provide for gear 80 to act as a linkage gear to enable the rotation of gear 82, which will enable control gear 84 to turn.

Adapters are used to enable the locking mechanism of the conventional door locks to turn and rotate. These adapters are coupled to the control gear of each gear system and to the locking mechanism of each conventional door lock.

Figure 6A:
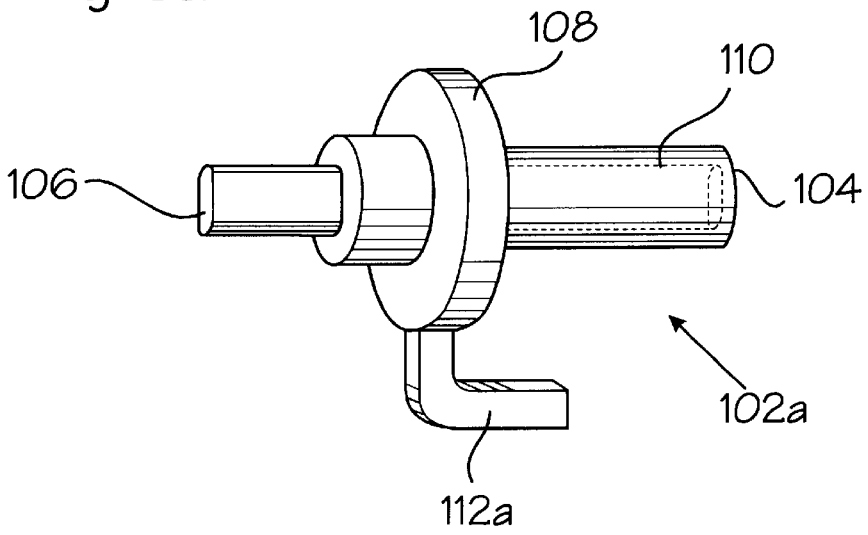
FIG. 6*a* is a perspective view of the adapter secured to the conventional rotating mechanism of the conventional deadbolt assembly and used with the remote control lock device of the present invention.

FIG. 6*a* illustrates the adapter which is used with the conventional deadbolt lock of the present invention. As shown, the adapter 102*a* is a hollow tubular structure having a first side 104, a second side 106, and a center portion 108. Extending through the adapter 102*a* is a center core 110 which is substantially the same shape as the conventional locking shaft (mechanism) of a conventional deadbolt. An L-shape member or finger 112 extends outwardly and downwardly from the center portion 110 of the adapter 102*a*. This L-shape member or finger 112 is received within the channel 70*a* of the control gear 68 (see FIGS. 1*a* and 4*a*). The first end 104 of the adapter 102*a* will receive the conventional lock shaft of the conventional deadbolt lock. The second end 106 will receive the interior door components (turn knob mechanism). This arrangement will provide for the adapter 102*a* to be sandwich between and will couple the lock mechanism and the interior hardware of the conventional deadbolt (see FIG. 9).

Figure 6B:
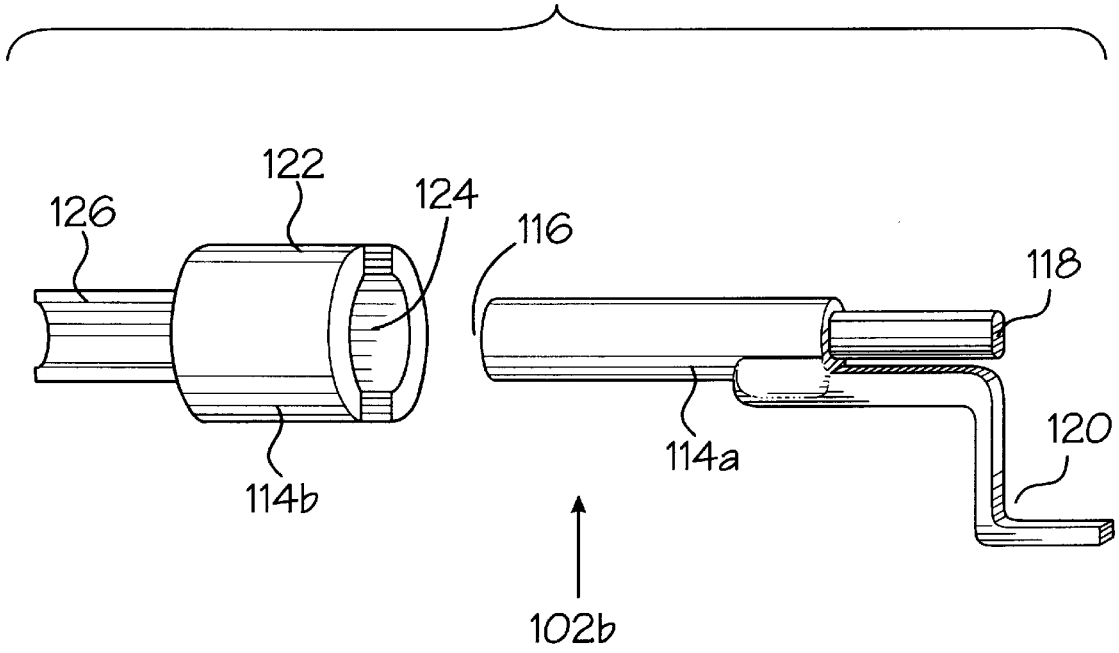
FIG. 6*b* is a perspective view of the adapter secured to the conventional rotating mechanism of the conventional doorknob assembly and used with the remote control lock device of the present invention.

The doorknob adapter 102*b* is illustrated in FIG. 6*b* and includes two elements, the interior portion 114*a* and an exterior portion 114*b*. The interior portion 114*a* is used for coupling the lock mechanism to the interior hardware of the conventional doorknob. The exterior portion 114*b* is designed so as to prevent the knob from turning, when activating the present invention, so as to solely render rotation of the lock mechanism.

As such, the interior portion 114*a* is an elongated member having a first end 116 and a second end 118. The second end is a solid shaft for receiving the core of the conventional doorknob lock assembly. The first end 116 is hollow and receives the lock mechanism of the conventional doorknob. Located between the first end and the second end is a "h" shape member or finger 120 which will be received within the channel 70*b* of the control gear for the doorknob lock assembly (see FIG. 4*a*).

The exterior portion 114*b* includes a hollow tubular member 122 having a central core 124. This center core 124 will receive the interior portion 114*a*. Extending outwardly from the interior area of the central core 124 is a C-shape flange 126. Extending outwardly from the opposite side of tubular member 122, exteriorly from the core, is a second C-shape flange, illustrated, but not labeled, which is substantially shorter in length than the first flange member.

When the interior portion 114*a* is located within the core 124, the finger 120 will extend outwardly from the second C-shape flange 126. The first C-shape flange is used as a stop, and is located oppositely from the turning mechanism of the conventional doorknob. This first C-shape flange 126 will prevent the knob mechanism from turning, yet, the interior portion 114*a* will still be free to rotate within the center core 124 of the exterior portion 114*b*.

Support brackets are used to maintain the conventional interior components of the deadbolt and the doorknob. The brackets are to be secured to the module unit 12 and each has a design and structure geared towards the particular lock mechanism.

Figure 7A:
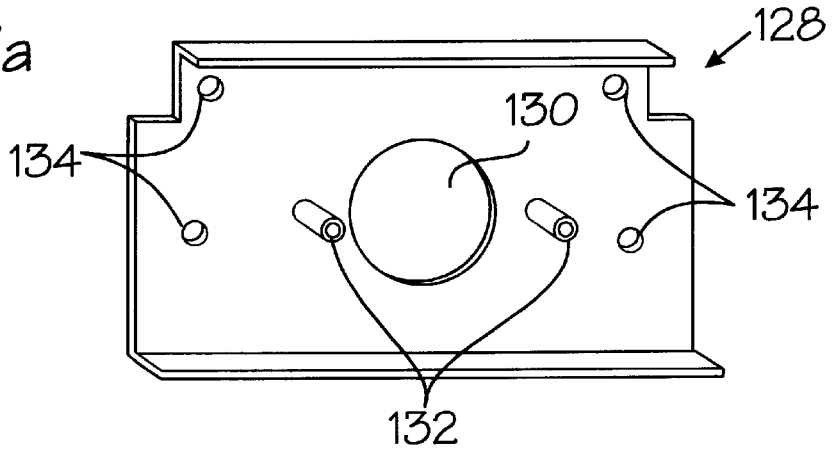
FIG. 7*a* is a perspective view of the receiving bracket used for receiving interior hardware of the conventional deadbolt assembly.

The mounting bracket 128 used to support the conventional interior hardware of the deadbolt is illustrated in FIG. 7*a*. As seen in this figure mounting bracket 128 is substantially rectangular in configuration and includes a central aperture 130 for receiving the center locking mechanism of the deadbolt and the second end of the adapter. Located on the side of the aperture 130 are hollow interiorly threaded rods 132 for receiving the conventional screws located on the conventional interior hardware of the deadbolt. A plurality of securing apertures 134 extend through the plate and are designed so as to align with hollow interiorly threaded shafts 32*a* and 32*b* located on the first support brace.

To use, the user secures aligns holes 134 to the threaded shafts 32*a* and 32*b*. This will enable the adapter to extend through the central aperture 130. Once aligned, screws or the like are inserted within the holes and shaft to secure the mounting bracket 128 to the first support brace. Thereby, providing for the holes and shaft to be a securing means, for securing the bracket to the brace. Once secured, the interior hardware is secured to the bracket via threaded rods 132. It is noted that the securing means is designed so as to provide only one means and method of attaching the bracket to the brace. It is further noted that this configuration and structure can be altered, by one of ordinary skill in the art, so as to provide for an alternative securing means.

Figure 7B:
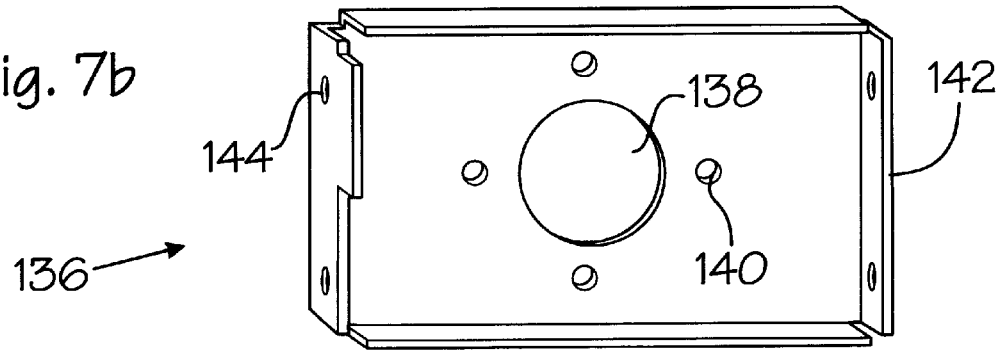
FIG. 7*b* is a perspective view of the receiving bracket used for receiving the interior hardware of the conventional door knob lock assembly.
Figure 7C:
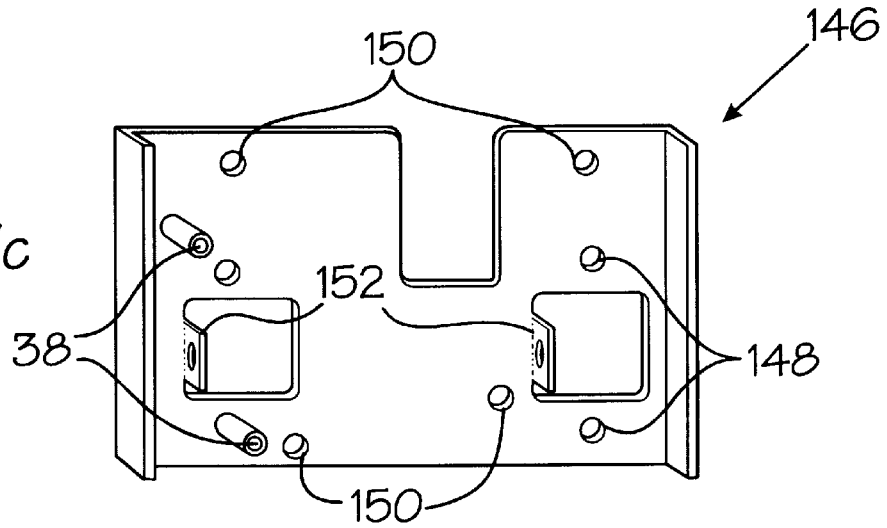
FIG. 7*c* is a perspective view of the receiving bracket used for receiving the motor assembly for the rotation of the conventional lock mechanism for a conventional deadbolt assembly and/or doorknob lock assembly.

The mounting bracket 136 for the conventional doorknob hardware is illustrated in FIG. 7*b*. As seen in this figure the mounting bracket 136 includes a central opening 138 for receiving the adapter 100*b* and hardware of the conventional doorknob. Surrounding the central opening 138 are a plurality of securing apertures 140 which include hollow internally threaded rods secured thereto. These securing apertures are designed to align with the openings 40 (see FIG. 1*a*) located within the second support brace. This will allow for the interior hardware of the doorknob to be secured thereto. Thereby, holes and securing apertures constitute a second securing means for securing the bracket to the brace. It is noted that the structure and configuration of the holes and securing apertures can be changed and altered by one of ordinary skill in the art so as to provide for an alternative arrangement which will act as a securing means.

Extending outwardly from the bracket 136 are side walls 142. Apertures 144 extend through the side wall and are design to align with through holes 44 which extend through the side walls of the second support brace 22*b* (see FIG. 1*a*). In the preferred arrangement, the side walls 142 will be located inside the side walls of the second support brace 22*b*.

To use, the user aligns holes 144 to the holes 44. This will enable the adapter to extend through the central aperture 130. Once aligned, screws or the like are inserted within the aligned holes, 44 and 144, respectively. Once secured, the interior hardware is secured to the bracket via the appropriate apertures 140.

For maintaining the motor, shaft and axles, a holding bracket is used. This holding bracket is illustrated in further detail in FIG. 7*c*. As seen in this figure, the holding bracket 146 includes a holes 148 for receiving a conventional brace for holding and securing motor to the bracket.

Axles 38 are secured to both the second support brace 22*b* and the holding bracket 146 for maintaining the appropriate gears. A plurality of holes 150 extend through the plate. These holes 150 are structured so as to align with internally threaded shafts 32*c* of the second support brace (see FIG. 1*a*), so as to enable the bracket to be secured to the second support brace when the electrical components are secured thereto. Flanges 152, having central apertures, can extend outwardly thereto. These central apertures will receive the shaft of the motor and can offer more structural support for the components.

Figure 8:
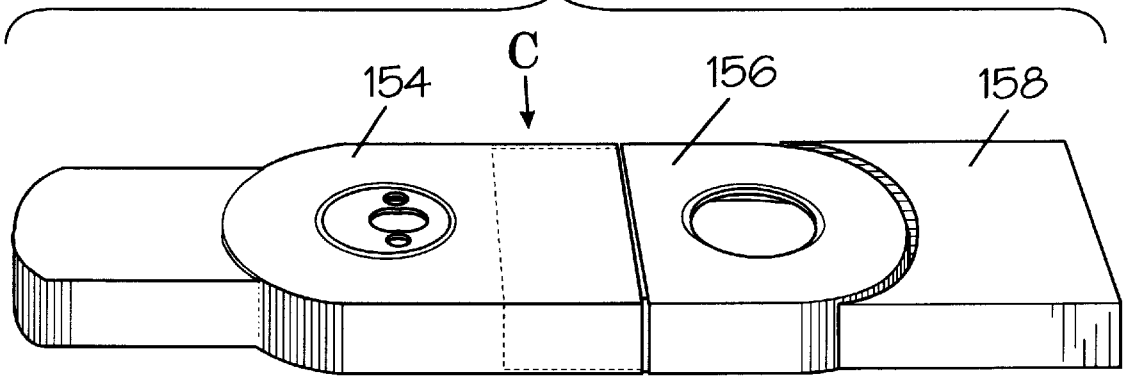
FIG. 8 is a perspective view of an example of a housing which can be used to with the remote control lock device of the present invention.

A cover C, as seen in FIG. 8, is placed over the device once it is assembled. This cover will protect and conceal the components of the assembly to provide for an aesthetically pleasing product. The cover can be a singular unit or optionally can be a device which can be altered in length, thereby providing a cover which can be installed onto a unit regardless of the location of the dead bolt or key lock. An example of a cover which can be used is illustrated in this figure.

As seen in the drawings, the cover C includes a first cover portion 154 which slidably receives a second cover portion 156. This will provides for a cover which is telescopic.

Each portion includes central openings, illustrated, but not labeled for receiving the conventional lock mechanism of the conventional deadbolt and door knob, respectively. Additional openings are provided for in the first cover portion 154 for receiving conventional screws of the conventional deadbolt hardware.

A separate cover 158 can be located at an end of the cover. This separate cover 158 will provide a means of covering the power supply for allowing quick and efficient removal therefrom for replace of the power source, without the need of disassembling the entire unit and cover. This cover is maintained via flange member 50, illustrated in FIG. 1*a*.

Figure 1B:
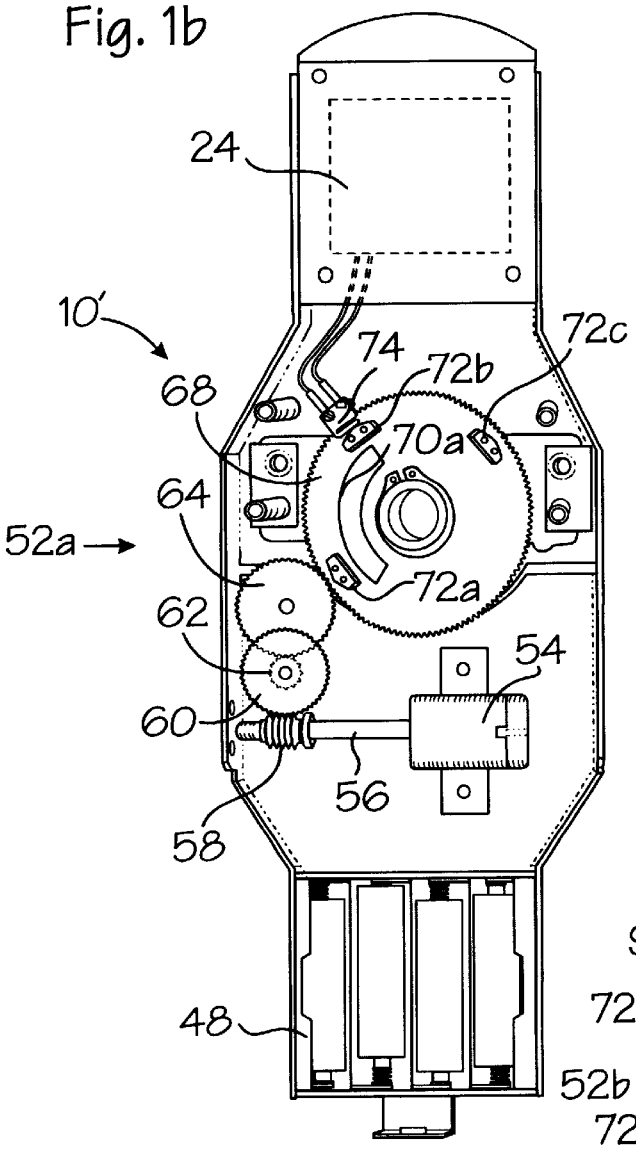
FIG. 1*b* is a top view of an alternative embodiment of the assembled the remote control lock device of the present invention for use with a conventional deadbolt assembly, having the cover removed therefrom.

Alternatively, the present invention can be used solely for a deadbolt or, optionally, used solely with a doorknob lock mechanism. Each of the embodiments is illustrated in further detail in FIGS. 1*b* and 1*c*, respectively. In the embodiment, for use solely with a deadbolt lock mechanism, the present invention 10', illustrated in FIG. 1*b*, includes a singular brace member having a first area 24, for maintaining the receiver or power supply and a second area 48, for maintaining the receiver or power supply. In this embodiment, the receiver is maintained within area 24 while the power supply is maintained within area 48.

A gear assembly is used to rotate the conventional locking mechanism of the deadbolt. The deadbolt gear assembly 52*a* includes a motor 54 having a shaft 56. The shaft 56 includes an outer end which is shape as an auger 58. This auger 58 contacts and engages a first rotating gear 60. This rotation gear 60 is coupled to a gear shaft 62 to provide for the rotating gear to be located above the gear shaft 62. Contacting and engaging the gear shaft 62 is a fixed gear 64. Engaging the fixed gear 64 is a control gear 68.

This control gear 68 is centrally located around the conventional shaft of the deadbolt unit, via the central opening illustrated, but not labeled, but is not coupled to the conventional shaft of the deadbolt unit. The control gear further includes a channel 70*a*. This channel 70*a* receives an adapter which is coupled to the rotating lock mechanism of the conventional deadbolt. Upon rotation of the control gear, the channel moves the adapter, which will consequently force the lock mechanism to turn to a desired direction. This adapted used is shown and discussed in FIG. 7*a*.

The control gear 68 controls the direction of rotation by having a plurality of cams 72*a*, 72*b*, and 72*c*, located thereon. A central cam 72*b* provides for the device to be in a neutral position. A lock cam is located on one side (72*a* or 72*c*, dependent on the type and style of deadbolt being utilized) of the central cam 72*b* while a unlock cam (72*a* or 72*c*, dependent on the type and style of deadbolt being utilized) is located on the opposite side of the central cam. A micro-switch 74 is located in proximity to the control gear and is in engageable contact with each cam. Accordingly, in operation, rotation of the gear will cease upon the contact between the particular cam and the micro-switch. For example, if the deadbolt is in an unlock position and the user wants to lock the unit, the motor will run and continue to run until the micro-switch engages the lock cam. Once contact is made, the control gear returns to its neutral position to enable further operation of the unit.

It is noted that the gear shaft 62 was provide as a space saving means, but can be eliminated if desired. In addition, the auger can be directly coupled to the fixed gear or optionally to the control gear 68. Optionally, it is further noted, that the size of the gears and number of gears utilized is dependent on the location of the motor with respect to the deadbolt assembly, and can be altered, reduced and changed as deemed necessary by an ordinary artesian in the field of gear assembly.

Figure 1C:
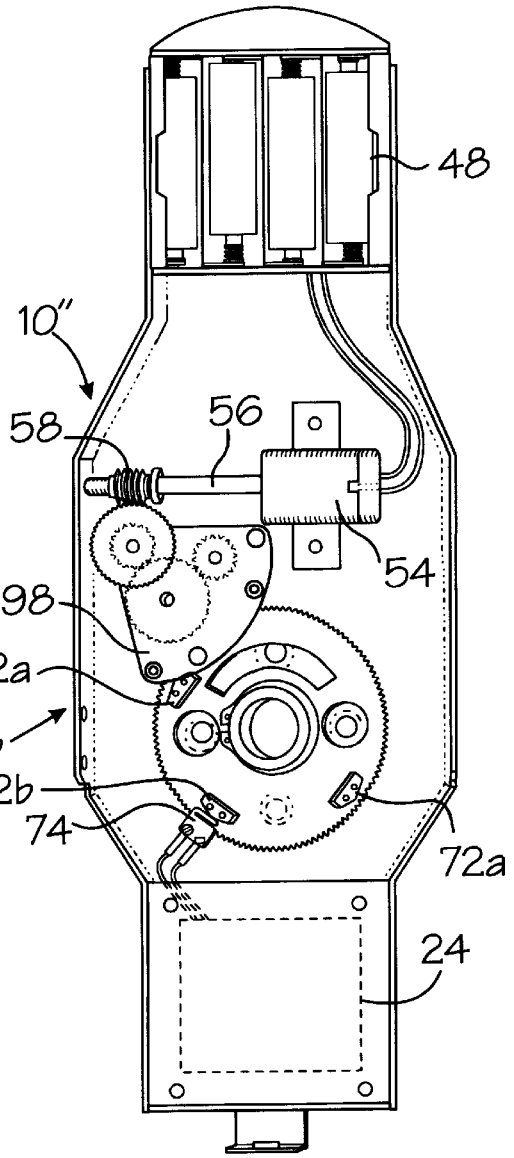
FIG. 1*c* is a top view of the assembled the remote control lock device of the present invention for use with a conventional door knob lock assembly, having the cover removed therefrom.

For use solely with a doorknob lock mechanism, the present invention 10", illustrated in FIG. 1*c*, includes a singular brace member having a first area 24, for maintaining the receiver or power supply and a second area 48, for maintaining the receiver or power supply. In this embodiment, the receiver is maintained within area 24 while the power supply is maintained within area 48.

A gear assembly is used to rotate the conventional locking mechanism of the doorknob assembly. The gear assembly 52*b* includes a motor 54 having a shaft 56. The shaft 56 includes an outer end which is shape as an auger 58. This auger 58 contacts and engages a first rotating gear 76. A gear shaft 78 is secured to the first gear 76. A linking/activating gear 80 is engaged to the gear shaft 78 and in an alternative arrangement is directly coupled to the control gear 84. This linking/activating gear 80 will directly engage the control gear 84 when a particular type of lock is used, such as the ones produce by SCHLAGE. If not contacting the control gear, then an activating gear 82 is sandwich between the linkage gear and the control gear, as illustrated in FIG. 5*b*. This arrangement is ideal for use with lock made by TITAN and KWIKSET. In summary, either gear 80 or 82 will be used to rotate the control gear 84. An adjusting plate is used to move and adjust the gears accordingly. This adjusting plate is illustrated and discussed in further detail in FIGS. 5*a*–5*b*.

It is noted that the gear shaft 78 was provide as a space saving means, but can be eliminated if desired. In addition, the auger can be directly coupled to the linking/activating gear 80. Optionally, it is further noted, that the size of the gears and number of gears utilized is dependent on the location of the motor with respect to the door knob assembly and that alterations and changes may be made by one having ordinary skill in the art without departing from the scope of the present invention.

The control gear 84 is centrally located around the conventional shaft of the doorknob unit via the central opening illustrated, but not labeled, and is not coupled to the conventional shaft of the doorknob unit. The control gear further includes a channel 70*b*. This channel 70*b* receives an adapter which is coupled to the rotating lock mechanism of the conventional deadbolt. Upon rotation of the control gear, the channel forces the adapter to rotate. Upon rotation of the adapter, the lock mechanism will inherently turn to the desired direction. This adapter is illustrated and discussed in further detail in FIG. 6*b*.

The control gear 84 controls the direction of rotation by having a plurality of cams 72*a*, 72*b*, and 72*c*, located thereon. A central cam 72*b* provides for the device to be in a neutral position. A lock cam is located on one side (72*a* or 72*c*, dependent on the type and style of doorknob lock being utilized) of the central cam 72*b* while a unlock cam (72*a* or 72*c*, dependent on the type and style of doorknob being utilized) is located on the opposite side of the central cam. A micro-switch 74 is located in proximity to the control gear and is in engageable contact with each cam. Accordingly, in operation, rotation of the gear will cease upon the contact between the particular cam and the micro-switch. For example, if the doorknob lock is in an unlock position and the user wants to lock the unit, the motor will run and continue to run until the micro-switch engages the lock cam. Once contact is made, the control gear returns to its neutral position to enable further operation of the unit.

Apertures 86 are also located within the control gear 84 for exposing the plurality of openings 40 located within the second support plate 22*b*. This will enable the second support brace to be secured to the conventional door knob lock assembly and yet provide for the screws inserted therein to be located under the gear, so as to be non-obtrusive. During activation, the motor will cause the shaft 56 to rotate. The rotation of the shaft will cause the auger 58 to turn which provide for the first gear to rotate. The rotation of the first gear 76 causes the gear shaft 78 to revolve, intrinsically causing the linkage/activation gear 82 to rotate. Dependent on the lock be used, either the activation gear 84 or the linkage/activation gear 82 will allow for the rotation of the control gear. Rotation of the control gear will cease upon the contact between the particular cam, and the micro-switch.

The system of the present invention, as defined in FIGS. 1–9, can be installed as a kit or can be retrofitted onto an existing door lock system as desired.

The unique design and configuration of the system of the present invention provides for a system which enables the unit to work via a remote control unit as well as be manually workable. In addition, the structure of the device when used with a door knob, provides a system which operates independently from the door knob. All which rotates is the locking mechanism. This rotation occurs by way of the motor as described above.

While the invention has been particularly shown and described with reference to an embodiment thereof, it will be understood by those skilled in the art that various changes in form and detail may be made without departing from the spirit and scope of the invention.

I claim:

1. A locking system to be used in combination with a conventional lock device, said locking system comprising:

a gear assembly coupled to a lock mechanism in a conventional lock device;

a receiver is coupled to said gear assembly;

a remote control device;

a transmitter is located within said remote control device;

said transmitter sends a signal to said receiver for activating said gear assembly and enabling said lock mechanism to rotate in a desired position; and said gear assembly includes at least a motor, having a shaft, a control gear and a micro-switch, said shaft is coupled to said control gear, and a plurality of cams are secured to said control gear, each cam represents a position for said lock mechanism, said positions include a lock position, a neutral position, and an unlock position, said micro-switch is located in proximity to said control gear and engageable to said cams, contact between said micro-switch and said cams will cease rotation of said lock mechanism for providing for said lock mechanism to be in a desired position.

2. A locking system as in claim 1 wherein said locking mechanism comprises a conventional door lock, having a knob attached thereto, and a conventional deadbolt.

3. A locking system as in claim 1 wherein a brace maintains said gear assembly, a mounting bracket couples said brace to said conventional lock mechanism for preventing marring or damage to an existing door.

4. A locking system as in claim 1 wherein said gear assembly and said receiver are secured to a base and said base, said gear assembly and said receiver constitute a modular unit.

5. A locking system as in claim 4 wherein said modular unit is coupled to said lock mechanism in said conventional lock device so as to prevent marring or damaging to occur to a door which houses said conventional lock device.

6. A locking system as in claim 2 wherein said gear assembly and said receiver is secured to a base and said base, said gear assembly and said receiver constitute a modular unit, a mounting bracket is coupled between said conventional lock mechanism and base, said module unit is coupled directly to said locking mechanism of said conventional door lock to provide for said module unit to be coupled to said locking mechanism and for preventing marring or damage to occur to an existing door which houses said lock mechanism.

7. A locking system as in claim 6 wherein said modular unit is adjustable in length to compensate for various distances which can occur between said conventional deadbolt and said conventional door lock.

8. A locking system to be used in combination with a conventional lock device, said locking system comprising:

a gear assembly coupled to a lock mechanism in a conventional lock device;

a receiver is coupled to said gear assembly;

a remote control device;

a transmitter is located within said remote control device;

said transmitter sends a signal to said receiver for activating said gear assembly and enabling said lock mechanism to rotate in a desired position; and said gear assembly includes at least a motor, having a shaft, a first control gear, a second control gear, and a micro-switch, said first control gear is coupled to said conventional door lock having a knob attached thereto, said second control gear is coupled to said conventional deadbolt, said shaft is coupled to said first control gear and said second control gear, a plurality of cams are secured to said first control gear, each cam represents a position for said lock mechanism, said positions include a lock position, a neutral position, and an unlock position, said micro-switch is located in proximity to said first control gear and engageable to said cams, contact between said micro-switch and said cams will cease rotation of said lock mechanism for providing for said lock mechanism to be in a desired position.

9. A locking system as in claim 8 wherein a first adapter is secured to said first gear and said locking mechanism of said conventional deadbolt, a second adapter is secured to said second gear and said locking mechanism of said conventional door lock having said knob attached thereto, and rotation of said first control gear forces rotation of said first adapter for forcing said conventional deadbolt locking mechanism to rotate, and rotation of said second control gear forces rotation of said second adapter for forcing said conventional door knob locking mechanism to rotate.

10. A locking system as in claim 1 wherein said attaching device enables attachment to a conventional dead bolt, a conventional door lock having a knob attached thereto, or a combination of a dead bolt and conventional door lock having a knob attached thereto.

11. A locking system comprising:

a gear assembly adapted to be secured and coupled to a lock mechanism in a conventional lock device;

an attaching device for attaching said gear assembly to said conventional lock device;

a receiver is coupled to said gear assembly;

a remote control device;

a transmitter is located within said remote control device; said transmitter sends a signal to said receiver for activating said gear assembly and enabling said lock mechanism to rotate in a desired position;

a cam assembly is secured to said gear assembly;

a contact unit is secured in proximity to said gear assembly and is engageable to and disable with said cam assembly to provide for said gear assembly to cease rotation when in a locked or unlocked position, so that said contact unit is engaged with said cam assembly when said locked device is locked or unlocked.

12. A locking system as in claim 11 wherein said cam assembly includes at least two cams enagagable to said contact unit, a first cam and a second cam constitutes said at least two cams; said first cam represents a lock position and said second cam represents an unlocked position.

13. A locking system as in claim 12 said contact unit is a micro-switch.

14. A locking system as in claim 11 wherein said locking mechanism comprises a conventional door lock, having a knob attached thereto, and a conventional deadbolt.

15. A locking system as in claim 1 wherein a brace maintains said gear assembly, a mounting bracket couples said brace to said conventional lock mechanism for preventing marring or damage to an existing door.

16. A locking system as in claim 11 wherein said gear assembly and said receiver are secured to a base and said base, said gear assembly and said receiver constitute a modular unit.

17. A locking system as in claim 16 wherein said modular unit is coupled to said lock mechanism in said conventional lock device so as to prevent marring or damaging to occur to a door which houses said conventional lock device.

18. A locking system as in claim 14 wherein said gear assembly and said receiver is secured to a base and said base, said gear assembly and said receiver constitute a modular unit, a mounting bracket is coupled between said conventional lock mechanism and base, said module unit is coupled directly to said locking mechanism of said conventional door lock to provide for said module unit to be coupled to said locking mechanism and for preventing marring or damage to occur to an existing door which houses said lock mechanism.

19. A locking system as in claim 18 wherein said modular unit is adjustable in length to compensate for various distances which can occur between said conventional deadbolt and said conventional door lock.

* * * * *